United States Patent [19]

Kaneko

[11] Patent Number: 4,876,872

[45] Date of Patent: Oct. 31, 1989

[54] METHOD AND APPARATUS FOR MANUFACTURING CURVED PIPE

[75] Inventor: Toshio Kaneko, Kanagawa, Japan

[73] Assignee: Kabushiki Kaisha Asahi Kinzoku Kogyosho, Kawasaki, Japan

[21] Appl. No.: 263,643

[22] Filed: Oct. 27, 1988

[30] Foreign Application Priority Data

Oct. 28, 1987 [JP] Japan ..... 62-270464

[51] Int. Cl.[4] ..... B21D 7/08; B21D 9/12

[52] U.S. Cl. ..... 72/133; 72/134; 72/166; 72/369

[58] Field of Search ..... 29/157 A; 72/133, 134, 72/166, 169, 369, 426, 427

[56] References Cited

U.S. PATENT DOCUMENTS 4,352,281 10/1982 Ragettli ..... 72/133 X
4,759,206 7/1988 Kaneko ..... 72/134

FOREIGN PATENT DOCUMENTS 251492 11/1962 Australia ..... 72/133
51-75664 6/1976 Japan ..... 72/133
53-146254 12/1978 Japan ..... 72/166
54-23677 8/1979 Japan .
58-202918 11/1983 Japan ..... 72/133
897331 1/1982 U.S.S.R. ..... 72/133

*Primary Examiner*—E. Michael Combs
*Attorney, Agent, or Firm*—Flynn, Thiel, Boutell & Tanis

[57] ABSTRACT

The present invention is directed to a curved pipe manufacturing method comprising the steps of: inserting a curved mandrel into a curved cavity of a fixed die having an entrance opening and an exit opening, the curved mandrel being attached to the distal end of an ejecting rod; forming a curved pipe by pressing a work, with a present rod through the entrance opening of the curved cavity into a curved annular chamber defined by the surfaces of the curved cavity and the mandrel; turning the movable block in one direction so that an ejecting rod attached at its base end with the movable block and concentrically integrated with the mandrel, ejects the mandrel together with the curved pipe from the entrance opening of the fixed die; advancing a movable chuck provided outside the entrance opening for chucking only the curved pipe; turning the movable block to another direction opposite to the one direction so as to return only the mandrel into the curved cavity of the fixed die; and retracting the movable chuck for removing the curved pipe. An apparatus for carrying out the curved pipe manufacturing method is also provided.

7 Claims, 4 Drawing Sheets

METHOD AND APPARATUS FOR MANUFACTURING CURVED PIPE

CROSS REFERENCE TO RELATED APPLICATION this application is related to U.S. Ser. No. 07/265 487, filed Nov. 1, 1988, and currently pending.

BACKGROUND OF THE INVENTION

1. Field of the Invention:

The present invention relates to a curved pipe manufacturing method and an apparatus for carrying out the same in which a straight pipe of stainless steel or the like is pressed into a fixed die having a curved cavity of a circular arc shape to form a curved pipe.

2. Description of the Prior Art:

Japanese Pat. Publication No. 54-23677 discloses a curved pipe manufacturing method employing an apparatus as illustrated in FIG. 4, invented by the inventor of the present invention. According to this known curved pipe manufacturing method, a work, namely, a straight pipe 5, is pressed with a presser rod 15 into a curved space conforming to the shape of a curved pipe to be formed, defined by a curved cavity 4 formed in a fixed die 1 to extending from the entrance opening 2 to the exit opening 3 of the fixed die 1. A curved mandrel 7 is secured to a movable block 6 so as to be inserted into and to be extracted from the curved cavity 4 of the fixed die 1, through the exit opening 3 of the fixed die 1 to form a curved pipe. Then the movable block 6 is turned to extract the mandrel 7 from the fixed die 1, and then the movable block 6 is turned further to push out the curved pipe from the fixed die 1 with an ejecting rod 8 attached to the movable block 6 opposite to the mandrel 7.

Inasmuch as the known curved pipe manufacturing method employs the mandrel 7 fixed to one end of the movable block 6 and the ejecting rod 8 at the other end of the movable block, the work, pressedly inserted through the entrance opening 2, is extracted from the exit opening 3 after it was subject to the curved pipe forming process, the known curved pipe manufacturing method has the following problems.

(1) Space is required for inserting the work into and extracting the work from both ends of the fixed die 1 (at the side of the entrance opening 2 and the exit opening 3 of the curved cavity 4) so that the apparatus necessarily becomes of large size.

(2) Since the direction for inserting the mandrel 7 is opposed to that for inserting the ejecting rod 8, the angle of rotation of the movable block 6 is greater than 180° which necessitates a device for rotatively driving the movable block 6 to be of large size.

SUMMARY OF THE INVENTION

Accordingly, it is an object of the present invention to provide a curved pipe manufacturing method, and an apparatus for carrying out the same, which eliminates the foregoing drawbacks of the known curved pipe manufacturing method and is capable of supplying the work to and extracting the work after being subjected to the curved pipe process, from the same opening.

It is another object of the present invention to provide a small curved pipe manufacturing apparatus.

It is further object of the present invention to provide a curved pipe manufacturing apparatus employing a small movable block for drivingly turning the movable block at an angle of slightly greater than 90°.

To achieve the above objects, the curved pipe manufacturing method of the present invention comprises the steps of: normally inserting a curved mandrel into a curved cavity of a fixed die having an entrance opening and an exit opening, the curved mandrel being attached to the distal end of a movable block; forming a curved pipe by pressing a work, with a presser rod, through the entrance opening of the curved cavity into a curved space defined by the surface of the curved cavity and the mandrel; turning the movable block in one direction so that an ejecting rod provided at the base side of the movable block and concentrically integrated with the mandrel ejects the mandrel together with the curved pipe from the entrance opening of the fixed die; advancing a movable chuck provided outside the entrance opening for chucking only the curved pipe; turning the movable block to another direction opposite to the one direction so as to return onlY the mandrel into the curved cavity of the fixed die; and retracting the movable chuck for removing the curved pipe.

The curved pipe manufacturing apparatus of the present invention comprises a fixed die having a curved cavity with an entrance opening and an exit opening, a mandrel formed into a shape capable of being inserted into the curved cavity of the fixed die and attached to the distal end of a movable block, a presser rod, for pressing a straight pipe into a curved space to form a curved pipe, is characterized in further comprising: an ejecting rod fixed to a movable block at a base thereof and fixed to the mandrel at the other end thereof and provided with a stepped portion for ejecting the curved pipe from the entrance opening; and a movable chuck provided outside the opening entrance of the fixed die for chucking the curved pipe.

The above and other objects, features and advantages of the present invention will become more apparent from the following description taken in conjunction with the accompanying drawings.

DESCRIPTION OF THE PREFERRED EMBODIMENT

Figure 1:
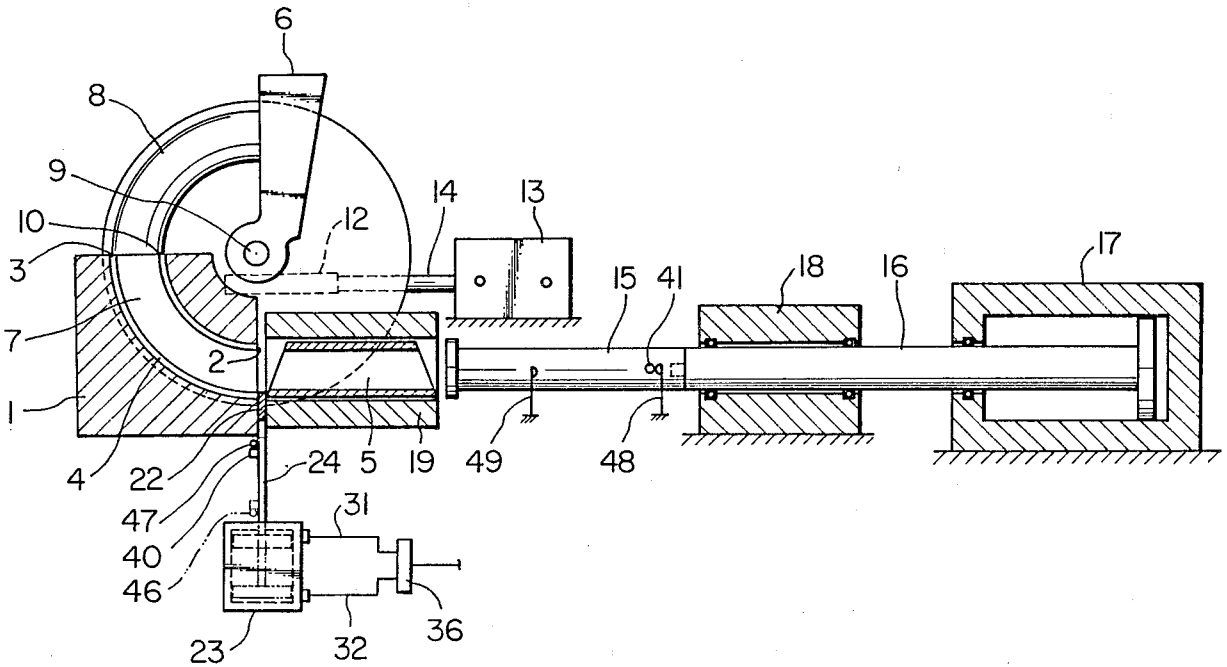
FIG. 1 is a sectional side elevation of a curved pip manufacturing apparatus, in a preferred embodiment, for carrying out a curved pipe manufacturing method according to the present invention.

A curved pipe manufacturing apparatus, in a preferred embodiment, according to the present invention will be described with reference to FIGS. 1 through 3.

A fixed die 1 has a curved cavity 4 of a circular arc shape having an entrance opening 2 and an exit opening 3. The edge of the entrance opening 2 is rounded to facilitate pressing a work 5, namely, a straight pipe, into the curved cavity 4. A mandrel 7 is attached to a movable block 6 at the base end thereof and an ejecting rod 8 at the distal end thereof. The mandrel 7 and the ejecting rod 8 are integrally formed with a stepped portion corresponding to the difference between the diameter of the mandrel 7 and the diameter of the ejecting rod 8 formed between them. The curved cavity 4, the mandrel 7 and the ejecting rod 8 are concentric. The movable block 6 is fixed to a rotary shaft 9 and can be turned about the rotary shaft 9. The diameter of the mandrel 7 is slightly smaller than the inside diameter of the work 5, while the diameter of the free end of the ejecting rod 8 is practically the same as the outside diameter of the work 5. The diameter of the curved cavity 4 is slightly greater than the outside diameter of the work 5.

Secured to one end of the rotary shaft 9 is a pinion 11 engaging a rack 12 which is joined to the free end of a piston rod 14 of a power cylinder 13.

A presser rod 15 for pressing the work 5 into a curved annular chamber formed between the surface of the curved cavity 4 of the fixed die 1 and the mandrel 7, has one end screwed in the free end of the piston rod 16 of a power cylinder 17. The presser rod 15 is operated by the power cylinder 17. The diameter of the other end, i.e., the free end, of the presser rod 15 is substantially the same as the outside diameter of the work 5. A guide member 18 is disposed near the front end of the piston rod 16 to support and guide the piston rod 16. The free end of the piston rod 16 extends beyond the guide member 18 on the side of the fixed die 1.

A movable pipe supporting member 19 is disposed in front of the entrance 2 of the fixed die 1 so as to be moved toward and away from the entrance opening 2 of the fixed die 1 by the piston rod 21 of a power cylinder 20. The movable supporting member 19 is separated from the entrance opening 2 of the fixed die 1 and is located at a receiving position indicated by imaginary lines in FIG. 2, where the work 5 is supplied into the movable supporting member 19.

A movable chuck 22 attached to a distal end of a piston rod 24 of a power cylinder 23 is disposed under the front of the entrance opening 2 of the fixed die 1 and is moved toward and away from the entrance opening 2 of the fixed die 1 by advancing and retracting motion of the piston rod 24 of the cylinder 23. Accordingly, when the movable chuck 22 is moved toward the entrance opening 2, it chucks only the curved pipe.

Pressurized working fluid supply/return tubes 25 and 26, 27 and 28, 29 and 30, and 31 and 32 are connected to the power cylinders 13, 17, 20 and 23, respectively. The pressurized working fluid supply/return tubes 25 and 26, 27 and 28, 29 and 30, and 31 and 32 are connected through selector valves 33, 34, 35 and 36, respectively, to a pressure generating machine such as an air compressor 37.

Projections 38, 39, 40 and 41 are provided on the piston rods 14, 21 and 24 and the presser rod 15, respectively. The projection 38 actuates sensors 42 and 43; the projection 39 actuates sensors 44 and 45; the projection 40 actuates the sensors 46 and 47; and the projection 41 actuates sensors 48 and 49. When actuated, the sensors sends signals to a controller 50, and then the controller 50 controls the selector valves 33, 34, 35 and 36 to control the operations of the power cylinders 13, 17, 20 and 23 according to the signals given thereto.

Figure 2:
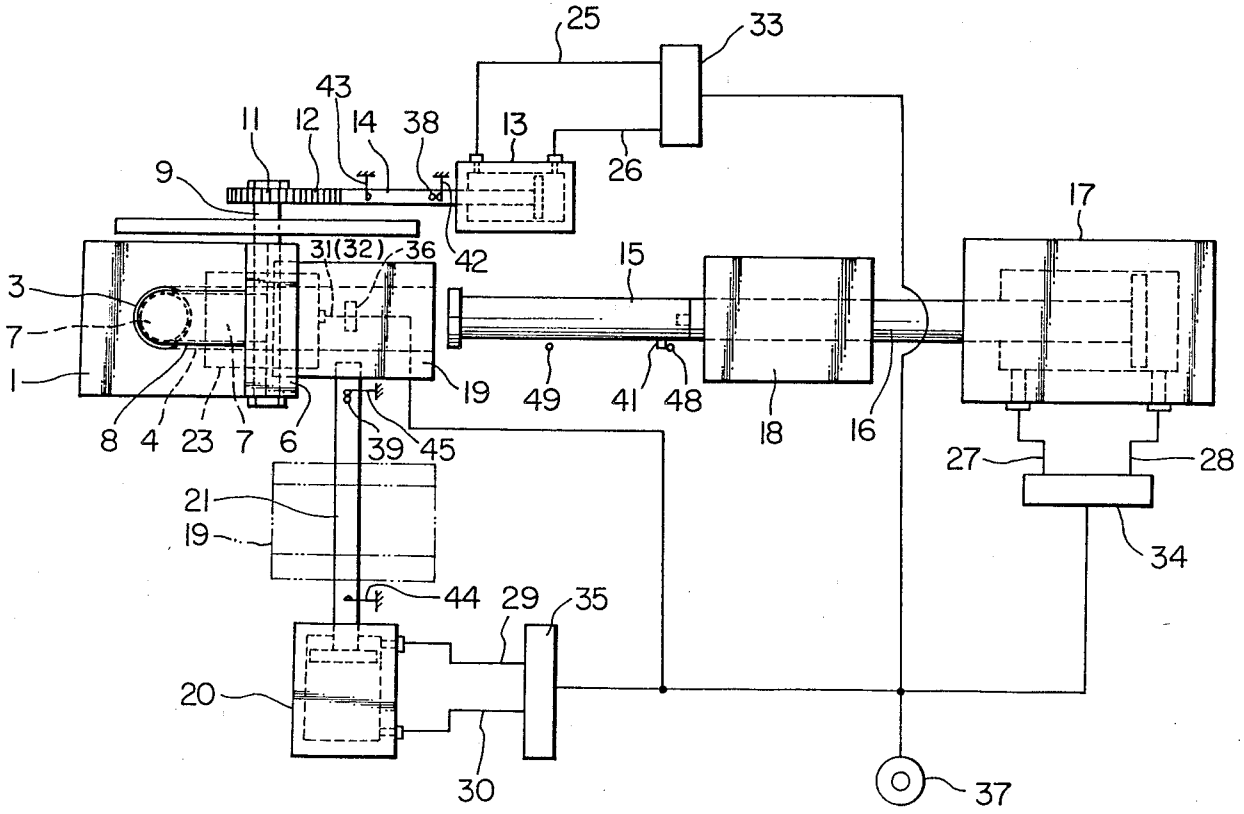
FIG. 2 is a plan view of the curved pipe manufacturing apparatus of FIG. 1.
Figure 3:
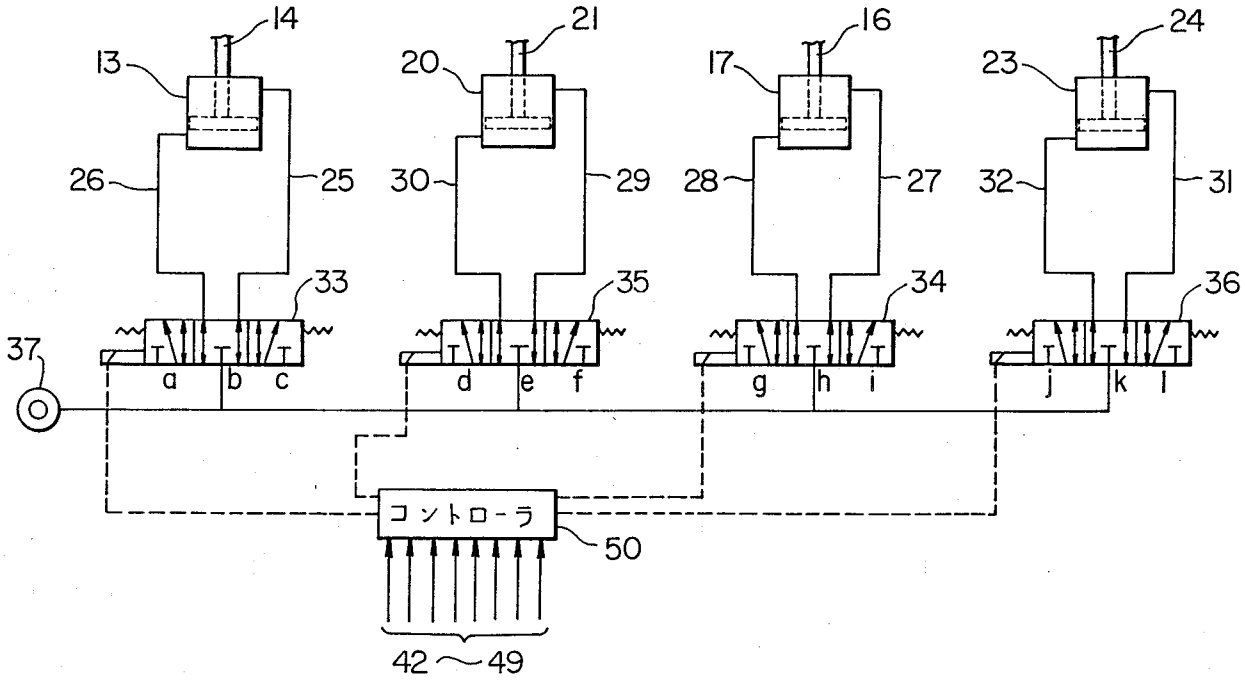
FIG. 3 is a circuit diagram of a controller for controlling the operation of the curved pipe manufacturing apparatus of FIG. 1.
Figure 4:
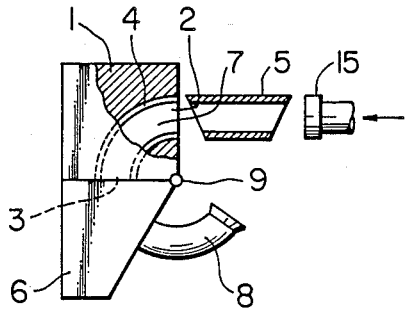
FIG. 4 PRIOR ART
FIG. 4 is a sectional side elevation of a conventional curved pipe manufacturing apparatus.

When the movable supporting member 19 is located at the receiving position indicated by imaginary line in FIG. 2, where the movable supporting member 19 receives the work 5, the mandrel 7 is located in place in the curved cavity 4 of the fixed die 1.

When actuated, the sensor 42 gives a signal to set the selector valve 33 at a position b, the selector valve 35 at a position d, and the selector valve 36 at a position I to the controller 50. Consequently, supply of the working fluid to the power cylinder 13 is interrupted to stop an advancing motion of the piston rod 14; the working fluid is supplied through the tube 30 into the rear chamber of the power cylinder 20; the working fluid is exhausted through the tube 29 from the front chamber of the power cylinder 20 to advance the piston rod 21 to move the movable supporting member 19 supporting the work 5 to a position immediately before the entrance opening 2 of the fixed die 1 and the piston rod 24 retracts, where the projection 39 of the piston rod 21 actuates the sensor 45. Then, the sensor 45 gives a signal to the controller 50 and thereby the controller 50 sets the selector valve 35 at a position e, and the selector valve 34 at a position g. Consequently, supply of the working fluid to the power cylinder 20 is interrupted to stop the advancing motion of the piston rod 21; the working fluid is supplied through the tube 28 into the rear chamber of the power cylinder 17 and the working fluid is exhausted from the front chamber of the power cylinder 17 through the tube 27 to advance the piston rod 16, and thereby the work 5 supported on the movable supporting member 19 is pressed into the curved space formed between the inner surface of the fixed die 1 and the mandrel 7 through the entrance opening 2 by the tip end of the presser rod 15.

As the work 5 is pressed into the fixed die 1 by the presser rod 15, the work 5 is bent gradually in a circular arc. After the work 5 has been pressed into the fixed die 1 by substantially the entire length thereof, the projection 41 of the presser rod 15 actuates the sensor 49. Then, the sensor 49 gives a signal to set the selector valve 34 at a position i to the controller 50. Consequently, the working fluid is supplied through the tube 27 to the front chamber of the power cylinder 17 and the working fluid in the rear chamber of the power cylinder 17 is exhausted through the tube 28 to retract the piston rod 16 slightly, whereby the presser rod 15 is returned to a position remote from the fixed die 1, and the projection 41 actuates the sensor 48. Then, the sensor 48 gives a signal to set the selector valve 34 at the position h and the selector valve 35 to the position f to the controller 50. Consequently, supply of the working fluid to the power cylinder 17 is interrupted to stop the retracting motion of the piston rod 16; the working fluid is supplied through the tube 29 into the front chamber of the power cylinder 20 and the working fluid in the rear chamber of the power cylinder 20 is exhausted through the tube 30 to retract the piston rod 21, whereby the movable supporting member 19 is returned to the original position. The projection 39 actuates the sensor 44 by the retracting motion of the piston rod 21.

The sensor 44 gives a signal to set the selector valve 35 at the position e, and the selector valve 33 at the position a to the controller 50. Consequently, supply of the working fluid to the power cylinder 20 is interrupted to stop the retracting motion of the piston rod 21; the working fluid is supplied through the tube 26 to the rear chamber of the power cylinder 13 and the working fluid in the front chamber of the power cylinder 13 is exhausted through the tube 25, so that the piston rod 14 is advanced and the rotary shaft 9 is turned with the rack 12 engaging the pinion 11, whereby the movable block 6 is turned toward the fixed die 1. As the movable block 6 is turned, the stepped portion 10 of the ejecting rod 8 pushes out the end of the processed curved pipe whereby the ejecting rod 8 is gradually inserted into the curved cavitY 4 and at the same time the mandrel 7 together with the processed curved pipe are pulled out from the entrance opening 2 of the fixed die 1. With the further advancing motion of the piston rod 14, the mandrel 7 and the processed curved pipe are entirely pulled out from the entrance opening 2 of the fixed die 1, the projection 38 actuates the sensor 43.

The sensor 43 gives a signal to set the selector valve 33 at the position b, and the selector valve 36 at the position j to the controller 50. Consequently, supply of the working fluid to the power cylinder 13 is interrupted to stop the advancing motion of the piston rod 14; the working fluid is supplied through the tube 32 to the rear chamber of the power cylinder 23 and the working fluid in the front chamber of the power cylinder is exhausted through the tube 31, so that the piston rod 24 advances, whereby the chuck 22 provided at the tip end of the piston rod 24 chucks the processed curved pipe, and the projection 40 actuates the sensor 47. Then, the sensor 47 gives a signal to set the selector valve 33 at a position c, the selector valve 36 at a position k to the controller 50. Consequently, supply of the working fluid to the power cylinder 23 is interrupted to stop the advancing motion of the piston rod 24, and the working fluid is supplied through the tube 25 into the front chamber of the power cylinder 13 and the working fluid in the rear chamber of the power cylinder 13 is exhausted through the tube 26 to retract the piston rod 14, whereby the rotary shaft 9 is turned with the rack 12 engaging the pinion 11 to turn the movable block 6 to move away from the fixed die 1. As the movable block 6 is turned, the ejecting rod 8 and the mandrel 7 are turned to the direction reversed to the direction just mentioned above, namely, to the direction for permitting the movable block 6 to move toward the fixed die 1 so that the mandrel 7 is inserted into the curved cavity 4 of the fixed die 1. At this time, inasmuch as the curved pipe is seized or chucked by the chuck 22 the curved pipe is not kept inserted with the mandrel 7 but remained outside of the fixed die 1 to be separated from the mandrel 7.

Upon the complete insertion of the mandrel 7 into the curved cavity 4 as the piston rod 14 retracts, the projection 38 actuates the sensor 42. Then, the sensor 42 gives a signal to set the selector valve 33 at the position b, the selector valve 35 at the position d, and the selector valve 36 at the position I to the controller 50. Consequently, supply of the working fluid to the power cylinder 13 is interrupted to stop the advancing motion of the piston rod 14; the working fluid is supplied through the tube 30 into the rear chamber of the power cylinder 20, and the working fluid in the front chamber of the power cylinder 20 is exhausted through the tube 29 to advance the piston rod 21, whereby the movable pipe supporting member 19 holding the work is moved again towards the position immediately before the entrance opening 2 of the fixed die 1. The working fluid is supplied through the tube 31 into the front chamber of the power cylinder 23, and the working fluid in the rear chamber of the power cylinder 23 is exhausted through the tube 32 to retract the piston rod 24 for allowing the chuck 22 to release chucking of the curved pipe. Thus, the curved pipe can be freely removed at the side of the entrance opening 2 of the fixed die 1.

A series of the foregoing actions is repeated to repeat the pipe bending process automatically.

To subject a work 5 having different outside diameter and inside diameter to the pipe bending process, another mandrel 7 having a diameter corresponding to the inside diameter of the work 5 and another ejecting rod 8 having a diameter corresponding to the outside diameter of the work 5 are attached to the movable block 6; the fixed die 1 is replaced by another fixed die 1 having a curved cavity 4 corresponding to the external shape of a curved pipe to be formed; another presser rod 15 having a diameter corresponding to the outside diameter of the work 5 is screwed in the free end of the piston rod 16; another movable pipe supporting member 19 suitable for supporting the new work 5 is connected to the piston rod 21.

The working fluid may be a hydraulic oil or compressed air. The pressure generating machine is an oil pump or an air compressor.

Although the invention has been described as applied to a horizontal curved pipe manufacturing apparatus, the present invention is not limited thereto in its application, the present invention is applicable also to a vertical curved pipe manufacturing apparatus.

Inasmuch as a curved pipe manufacturing method and an apparatus for carrying out same according to the present invention is capable of supplying the work to and extracting the work after subjected to the curved pipe process from the same portion, spaces are not required for inserting the work into and extracting the work from both ends of the fixed die (at the side of the entrance and exit openings of the curved cavity 4) so that the apparatus becomes small sized.

Inasmuch as the mandrel to be normally inserted in the curved cavity and the ejecting rod for ejecting the curved pipe is integrally formed and fixed to the movable block, the device to drive the movable block to turn at the angle of slightly greater than 90° can be small sized whereby the apparatus can be small sized as a whole. Furthermore, the curved pipe can be automatically manufactured. Still furthermore, since the curved pipe can be automatically manufactured with use of a controller provided with a simple structured sensors, the working efficiency can be remarkably improved.

Although the invention has been described in its preferred form with a certain degree of particularity, it is to be understood that many variations and changes are possible in the invention without departing from the scope and spirit thereof.

What is claimed is:

1. A curved pipe manufacturing method comprising the steps of:

(1) providing a fixed die having a curved cavity, an entrance opening and an exit opening contained therein, said curved cavity being formed in a circular arc and extending from said entrance opening to said exit opening;

(2) providing a movable block, an ejecting rod and a curved mandrel, said movable block being attached to said ejecting rod at a basal end of said ejecting rod and said curved mandrel being concentrically attached to said ejecting rod at a distal end of said ejecting rod, said ejecting rod being of greater diameter than said curved mandrel and forming a stepped surface with said curved mandrel where said curved mandrel is concentrically attached to said ejecting rod;

(3) inserting the curved mandrel into the curved cavity of the fixed die through the exit opening therein and forming a curved annular chamber inside said cavity;

(4) pressing a work with a presser rod through said entrance opening into aid curved annular chamber to form a curved pipe;

(5) turning the movable block in a first direction so that the mandrel and the curved pipe are ejected from the entrance opening of the fixed die;

(6) advancing a movable chuck provided adjacent said entrance opening to a position where said movable chuck contacts a rear end portion of said curved pipe and restrains the movement of said curved pipe in a direction opposite to said first direction;

(7) turning said movable block in said direction opposite to said first direction so as to return only the mandrel into the curved cavity of the fixed die; and (8) retracting the ;movable chuck to recover the curved pipe.

2. A curved pipe manufacturing method as recited in claim 1, wherein the work is loaded on a movable supporting member positioned at the entrance opening of the fixed die by an advancing motion of the movable supporting member, inserted through the entrance opening into the curved annular chamber by an advancing motion of the presser rod where the work is processed into a curved pipe, ejected by the ejecting rod, chucked by the chuck at the rear end portion thereof and extracted by a retractive motion of the chuck from the entrance opening of the fixed die.

3. A curved pipe manufacturing method as recited in claim 1, wherein the mandrel is turned at an angle of slightly greater than 90° for ejecting the curved pipe and then returned to the original position.

4. A curved pipe manufacturing method as recited in claim 1, further comprising the step of applying a lubricant to the external and internal surfaces of the work prior to subjecting the work to the curved pipe forming process.

5. A curved pipe manufacturing apparatus comprising:

a fixed die having a curved cavity, an entrance opening and an exit opening contained therein, said curved cavity being formed in a circular arc and extending from said entrance opening to said exit opening;

a movable block mounted for circular movement with respect to said fixed die;

a curved mandrel adapted to the inserted into said curved cavity and form a curved annular chamber therein;

an ejecting rod for ejecting a curved pipe from said entrance opening of said fixed die, said movable block being attached to a basal end of said ejecting rod and said curved mandrel being concentrically attached to a distal end of said ejecting rod, said ejecting rod being of greater diameter than said curved mandrel and forming a stepped surface with said curved mandrel where said curved mandrel is concentrically attached to said ejecting rod;

a presser rod for pressing a work into said curved annular chamber to form a curved pipe; and a movable chuck provided adjacent said entrance opening of said fixed die, said movable chuck being capable of reciprocating movement to and from said entrance opening and engaging a rear end portion of said curved pipe to restrain the movement of said curved pipe in one direction.

6. A curved pipe manufacturing apparatus comprising:

a fixed die having a curved cavity, an entrance opening and an exit opening therein, said curved cavity being formed in a circular arc and extending from said entrance opening to said exit opening;

a movable block mounted for circular movement with respect to said fixed die;

a curved mandrel adapted to be inserted into said curved cavity and forming a curved annular chamber therein;

an ejecting rod adapted to be inserted into said exit opening of said fixed die and eject a curved pipe from aid entrance opening of said fixed die, said movable block being attached to a basal end of said ejecting rod and said curved mandrel being concentrically attached to a distal end of said ejecting rod, said ejecting rod being of greater diameter than said curved mandrel and forming a stepped surface with said curved mandrel where said curved mandrel is concentrically attached to said ejecting rod;

a presser rod for pressing a work pipe into said curved annular chamber to form a curved pipe;

a movable chuck provided adjacent the entrance opening of the fixed die, said movable chuck being capable of reciprocating movement to and from the entrance opening of the fixed die by means of a piston rod of a power cylinder and engaging a rear portion of said curved pipe to restrain the movement of said curved pipe in a first direction; and a rotary shaft on which said movable block is fixedly mounted, said rotary shaft being capable of driving said movable block in a second direction, opposite said first direction, toward the exit opening of the fixed die to force the ejecting rod to eject the curved pipe from the entrance opening of the fixed die and in said first direction to return said curved mandrel into said curved cavity through said entrance opening.

7. A curved pipe manufacturing apparatus as recited in claim 6, further comprising a movable work supporting member disposed in front of the entrance opening of the curved cavity of said fixed die so as to support and guide the work when the work is pressed into the fixed die with said presser rod.

* * * * *

UNITED STATES PATENT AND TRADEMARK OFFICE

CERTIFICATE OF CORRECTION

PATENT NO. : 4 876 872

DATED : October 31, 1989

INVENTOR(S) : Toshio KANEKO

It is certified that error appears in the above-identified patent and that said Letters Patent is hereby corrected as shown below:

Column 8, line 24; change "aid" to ---said---.

Signed and Sealed this

Nineteenth Day of March, 1991

*Attest:*

HARRY F. MANBECK, JR.

*Attesting Officer*

*Commissioner of Patents and Trademarks*